US010638817B2

(12) United States Patent
Kaiko

(10) Patent No.: US 10,638,817 B2
(45) Date of Patent: May 5, 2020

(54) HOOK-AND-LOOP FASTENER PROVIDED WITH HOLLOW WOVEN PART

(71) Applicant: Kuraray Fastening Co., Ltd., Osaka-shi (JP)

(72) Inventor: Takayoshi Kaiko, Fukui (JP)

(73) Assignee: Kuraray Fastening Co., Ltd., Osaka-shi (JP)

( * ) Notice: Subject to any disclaimer, the term of this patent is extended or adjusted under 35 U.S.C. 154(b) by 232 days.

(21) Appl. No.: 15/553,633

(22) PCT Filed: Mar. 8, 2016

(86) PCT No.: PCT/JP2016/057078

§ 371 (c)(1),
(2) Date: Aug. 25, 2017

(87) PCT Pub. No.: WO2016/143766

PCT Pub. Date: Sep. 15, 2016

(65) Prior Publication Data

US 2018/0014611 A1 Jan. 18, 2018

(30) Foreign Application Priority Data

Mar. 12, 2015 (JP) ..... 2015-049045

(51) Int. Cl.
*A44B 18/00* (2006.01)

(52) U.S. Cl.
CPC ..... *A44B 18/0034* (2013.01); *A44B 18/0023* (2013.01); *A44B 18/0084* (2013.01); *A44B 18/0088* (2013.01)

(58) Field of Classification Search
CPC ..... A44B 18/0034; A44B 18/0023; A44B 18/0084; A44B 18/0088
See application file for complete search history.

(56) References Cited

U.S. PATENT DOCUMENTS 6,349,750 B1 2/2002 Fujiwara
6,357,487 B2 * 3/2002 Okawa ..... A44B 18/0023 139/392
6,443,187 B1 * 9/2002 Wang ..... A44B 18/0023 139/391

(Continued)

FOREIGN PATENT DOCUMENTS

EP 1 149 542 A2 10/2001
EP 1 366 686 A2 12/2003

(Continued)

OTHER PUBLICATIONS

Extended European Search Report dated Oct. 8, 2018 in European Patent Application No. 16761734.9, 8 pages.

(Continued)

*Primary Examiner* — Robert Sandy
*Assistant Examiner* — Louis A Mercado
(74) *Attorney, Agent, or Firm* — Oblon, McClelland, Maier & Neustadt, L.L.P.

(57) ABSTRACT

A hook-and-loop fastener including a base cloth composed of warps, a weft, and engaging element yarns and engaging elements formed of the engaging element yarns and provided on a surface of the base cloth. The hook-and-loop fastener includes a hollow woven part satisfying at least four specific requirements.

5 Claims, 15 Drawing Sheets

(56) References Cited

U.S. PATENT DOCUMENTS

| | | | | |
|---|---|---|---|---|
| 6,728,998 | B2 * | 5/2004 | Wang | A44B 18/0023 24/265 WS |
| 7,387,975 | B2 * | 6/2008 | Okawa | A44B 18/0023 139/391 |
| 2001/0035225 | A1 | 11/2001 | Okawa | |
| 2003/0221298 | A1 | 12/2003 | Murayama et al. | |
| 2004/0006854 | A1 | 1/2004 | Simon | |
| 2006/0032033 | A1 | 2/2006 | Murayama et al. | |

FOREIGN PATENT DOCUMENTS

| | | | |
|---|---|---|---|
| GB | 1 400 080 | A | 7/1975 |
| JP | 2001-115357 | A | 4/2001 |
| JP | 2001-309805 | A | 11/2001 |
| JP | 2003-339413 | A | 12/2003 |
| JP | 2014-27989 | A | 2/2014 |
| WO | WO 99/49750 | A1 | 10/1999 |
| WO | 2010/137193 | A1 | 12/2010 |

OTHER PUBLICATIONS

International Search Report dated May 24, 2016 in PCT/JP2016/057078 filed Mar. 8, 2016.

* cited by examiner

HOOK-AND-LOOP FASTENER PROVIDED WITH HOLLOW WOVEN PART

TECHNICAL FIELD

The present invention relates to a hook-and-loop fastener having a hollow woven part. Specifically, the present invention relates to a hook-and-loop fastener having a hollow woven part formed of double-layered fabric that consists of a front woven part and a back woven part provided with engaging elements on external surfaces.

BACKGROUND ART

A woven part having hook-shaped engaging elements on a surface and a woven part having loop-shaped engaging elements have widely been used as a typical hook-and-loop fastener. By placing either of the woven part on another woven part with the surfaces provided with the engaging elements facing each other, the hook-shaped engaging elements engage with the loop-shaped engaging elements, whereby the two woven parts are combined as a single part.

To cover a surface of a bar-shaped object or a linear object with a hook-and-loop fastener, a method has been known such as: wrapping the bar-shaped object or the linear object with the hook-and-loop fastener and then fixing the hook-and-loop fastener using an adhesive, a glue, or the like to the surface of the bar-shaped object or the liner object; or sewing the hook-and-loop fastener into a hollow shape with the engaging elements on an external surface so that the bar-shaped object or the linear object is inserted in the hollow.

In such methods, however, a step of sewing the hook-and-loop fastener, a step of bonding the hook-and-loop fastener using an adhesive or a glue, a step of wrapping the bar-shaped object or the like with the hook-and-loop fastener, and the like are necessary, which means additional steps and work are necessary.

Such methods are not suitable for a brush composed of a bar-shaped object and a hook-and-loop fastener that covers a surface of the bar-shaped object, in which the brush is dipped in a liquid to put and keep an application liquid on engaging elements provided on the hook-and-loop fastener. It is because, in such a use, components in an adhesive or a glue might permeate into the application liquid.

Furthermore, when a textile is attached to the back surface of the hook-and-loop fastener by sewing or using an adhesive to be shaped like a hollow, the hollow part easily comes off the hook-and-loop fastener. It needs an extra work to firmly bond the textile by sewing or using an adhesive so as not to come off, and such firm bonding greatly deteriorates flexibility of the hook-and-loop fastener.

In a typical method of detachably attaching a component such as an electronic part to a surface of an object, a hook-and-loop fastener is attached to the surface of the component using an adhesive or a glue and another hook-and-loop fastener is attached to the surface of the object to engage the two hook-and-loop fasteners. This method, however, is not applicable if the hook-and-loop fastener cannot be attached to the surface of the component or if attaching of the hook-and-loop fastener deteriorates the performance or quality of the component. An alternative method for such a case is to insert the component in a hollow of the hook-and-loop fastener and engage the hook-and-loop fastener with another hook-and-loop fastener attached to the object. This method includes preparation of a hollow part that accommodates the component and attaching of a hook-and-loop fastener to the hollow part by sewing or using an adhesive, which requires additional work.

The inventors have studied a technique that does not require such additional work and solves the problem of a hollow woven part coming off the back surface. The inventors have found out that the aforementioned problem of the prior art can be solved by forming a hollow woven part integrated with a hook-and-loop fastener during manufacturing of the hook-and-loop fastener.

A hook-and-loop fastener having a hollow woven part has been known (see Patent Literature 1). The Patent Literature discloses that the shape of a hook-and-loop fastener can be fixed by inserting hard core members in thin hollow woven parts provided on both rims of the hook-and-loop fastener to extend in the longitudinal direction of the hook-and-loop fastener. The rims are, namely, thin edge portions where no engaging element is provided.

Although the technique disclosed in Patent Literature 1 allows insertion of a thin core member, there is a limit in the size of a component that can be inserted in a hollow woven part formed in the thin rim, which is as wide as a few millimeters, of the hook-and-loop fastener. A thick bar-shaped object or a wide component cannot be inserted in the hollow woven part. Moreover, the technique disclosed in the Patent Literature does not have engaging elements provided on the hollow woven part, so that the hollow woven part cannot be fixed directly to the hook-and-loop fastener. Therefore, the hollow woven part rises above the attaching surface, which discourages stable attachment of the hook-and-loop fastener. This limits variation of the applicable shape.

An object of the present invention is to provide a hook-and-loop fastener that can be manufactured with a hollow woven part having an any arbitrary width, not limited to a narrow width as in Patent Literature 1, and with engaging elements provided also on a surface of the hollow woven part. Furthermore, an object of the present invention is to provide a hook-and-loop fastener having a hollow woven part that does not come off a back surface of the hook-and-loop fastener.

CITATION LIST

Patent Literature

Patent Literature 1: WO 2010/137193 A (paragraphs 0031 to 0032, FIGS. 9 to 11)

SUMMARY OF INVENTION

An aspect of the present invention relates to a hook-and-loop fastener including a base cloth composed of warps, a weft, and engaging element yarns and engaging elements formed of the engaging element yarns and provided on a surface of the base cloth. The hook-and-loop fastener includes a hollow woven part satisfying the following requirements that:

1) the base cloth has the hollow woven part formed of a double-layered fabric that consists of a front woven part and a back woven part;

2) the weft constituting the front woven part continues to the weft constituting the back woven part to form the hollow woven part, or alternatively, the weft or warps constituting a single-layer woven part, in a region where the hollow woven part is not formed, are divided into yarns constituting the front woven part and yarns constituting the back woven part to form the hollow woven part;

3) the engaging elements are provided on an external surface of the front woven part of the hollow woven part; and 4) the weft contains thermal bonding fibers and the engaging element yarns are fixed to the base cloth by the thermal bonding fibers.

With such a structure as described above, a hook-and-loop fastener can be manufactured to have a hollow woven part with any arbitrary width, not limited to a narrow hollow woven part. Moreover, a hook-and-loop fastener provided with engaging elements also on a surface of the hollow woven part can be provided. Furthermore, a hook-and-loop fastener having a hollow woven part that does not come off the back surface of the hook-and-loop fastener may be provided.

DESCRIPTION OF EMBODIMENTS

Figure 1:
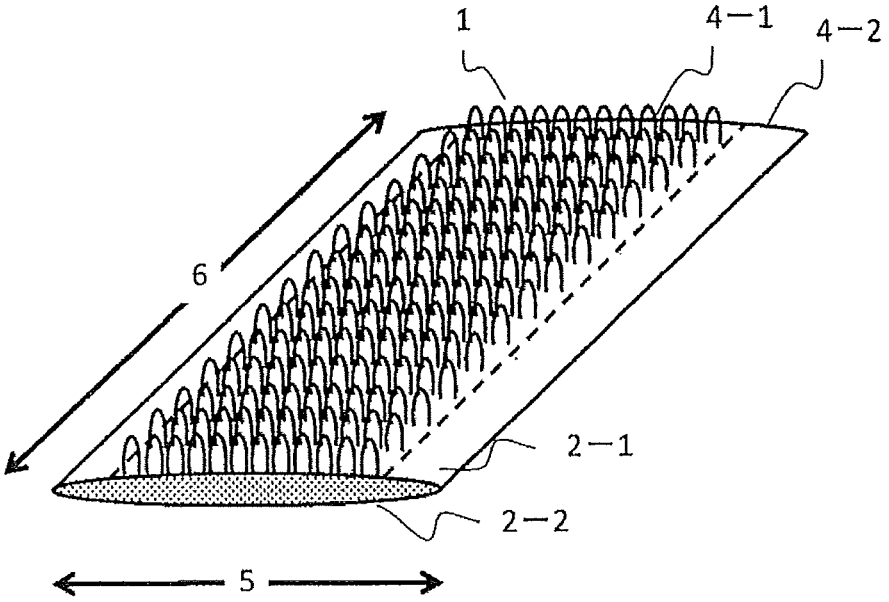
FIG. 1 is a perspective view schematically illustrating an example of a loop fastener having a hollow woven part according to the present invention.

A hook-and-loop fastener according to an embodiment of the present invention includes a base cloth composed of warps, a weft, and engaging element yarns and engaging elements formed of the engaging element yarns and provided on a surface of the base cloth. The hook-and-loop fastener includes a hollow woven part satisfying the following requirements that:

1) the base cloth has the hollow woven part formed of a double-layered fabric that consists of a front woven part and a back woven part;

2) the weft constituting the front woven part continues to the weft constituting the back woven part to form the hollow woven part, or alternatively, the weft or warps constituting a single-layer woven part, in a region where the hollow woven part is not formed, are divided into yarns constituting the front woven part and yarns constituting the back woven part to form the hollow woven part;

3) the engaging elements are provided on an external surface of the front woven part of the hollow woven part; and 4) the weft contains thermal bonding fibers and the engaging element yarns are fixed to the base cloth by the thermal bonding fibers.

The hook-and-loop fastener according to the present invention has a hollow woven part formed of a double-layered fabric that consists of a front woven part and a back woven part provided on a base cloth. A weft of the front woven part continues to a weft of the back woven part, or alternatively, the weft or warps constituting the front woven part and the back woven part together constitute a single-layer woven part in a region where the hollow woven part is not formed. Further, engaging elements are provided on a surface of the hollow woven part, and therefore the hollow woven part can have any length in the weft direction or the warp direction. Hence, the hollow woven part may have an increased length in the weft direction or the warp direction to insert a thick bar-shaped object or a wide component in the hollow woven part. Moreover, the hollow woven part can be made endless in the warp direction as required. Therefore, the hook-and-loop fastener that is to be attached to the bar-shaped object can have any arbitrarily length.

Accordingly, by simply inserting a bar-shaped object or a component in an expanded space inside the hollow woven part of the hook-and-loop fastener according to the present invention, the surface of the bar-shaped object or the component can be covered with the hook-and-loop fastener. Advantageously, an additional work required in the prior art to cover the surface of the bar-shaped object with the hook-and-loop fastener or to attach the hook-and-loop fastener to the surface of the component is greatly reduced.

For a conventional hook-and-loop fastener composed of a woven base cloth, an adhesive liquid (back-coat resin liquid) is applied on the back surface of the base cloth to fix engaging element yarns to the base cloth, so as to prevent the engaging elements from being pulled out of the base cloth. To use this prior art for the base cloth forming a hollow woven part that has engaging elements provided on the external surface of the hollow woven part, the adhesive liquid needs to be applied on the internal surface of the hollow woven part during a manufacturing step of the hook-and-loop fastener to prevent the engaging elements from being pulled out. However, applying the adhesive liquid on the internal surface of the hollow woven part is almost impossible.

In contrast, a technique of fixing the engaging element yarns to the base cloth by melting thermal bonding fibers used in the weft during the process of manufacturing a hook-and-loop fastener as in the present invention solves the problem in a conventional art that the engaging element yarns cannot be fixed to the base cloth because an adhesive liquid cannot be applied on the back surface of the base cloth of the hook-and-loop fastener. That is, the problem that in a manufacturing process of a conventional hook-and-loop fastener, a hollow woven part cannot be manufactured together with the hook-and-loop fastener can be solved.

A conventional hook-and-loop fastener having a hollow woven part also has a problem that the hollow woven part easily comes off the hook-and-loop fastener, by sewing a textile into a hollow shape or by bonding a hollow-shaped textile using an adhesive to the back surface of an already manufactured hook-and-loop fastener. However, in the hook-and-loop fastener according to the present invention, the weft constituting the front woven part of the hollow woven part continues to the weft constituting the back woven part of the hollow woven part or, in a case where a single-layer woven part is formed in a region where the hollow woven part is not formed, the weft or the warps constituting the hollow woven part constitutes the single-layer woven part. Thus, the hook-and-loop fastener according to the present invention is free of the problem of the hollow woven part coming off the hook-and-loop fastener.

Moreover, a region in the back surface of the hook-and-loop fastener where the hollow woven part is attached using an adhesive or by sewing, as in the conventional method, loses flexibility because the adhesive or the sewed textile stiffens the region. In contrast, the hook-and-loop fastener according to the present invention, in which the hollow woven part is not attached to the back surface of the hook-and-loop fastener, does not lose flexibility that the hook-and-loop fastener originally has.

Thus, the hook-and-loop fastener according to the present invention has various advantages.

Hereinafter, the hook-and-loop fastener and its preferable embodiment according to the present invention will be described with reference to the drawings, but the present invention is not limited thereto.

Reference signs used in the drawings denote the following.

Figure 12:
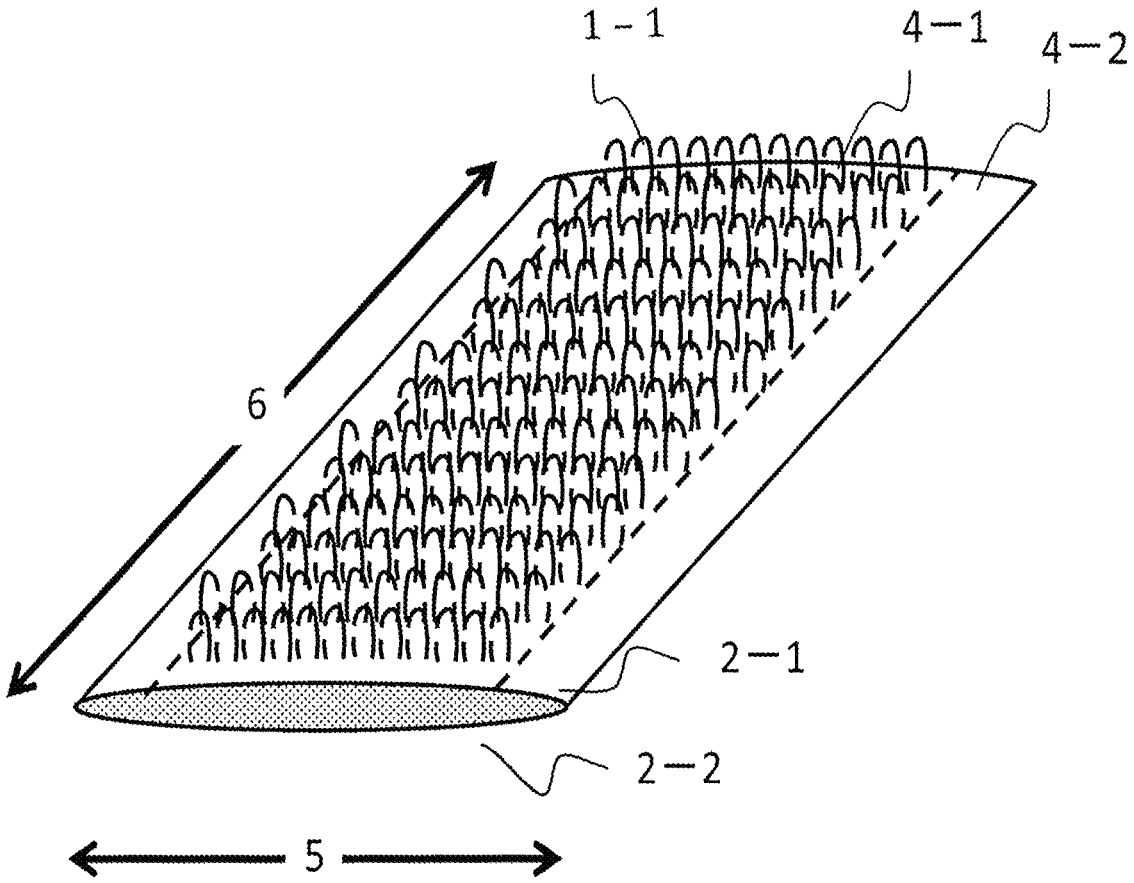
FIG. 12 is a perspective view schematically illustrating an example of the hook fastener having the hollow woven part according to the present invention.
Figure 13:
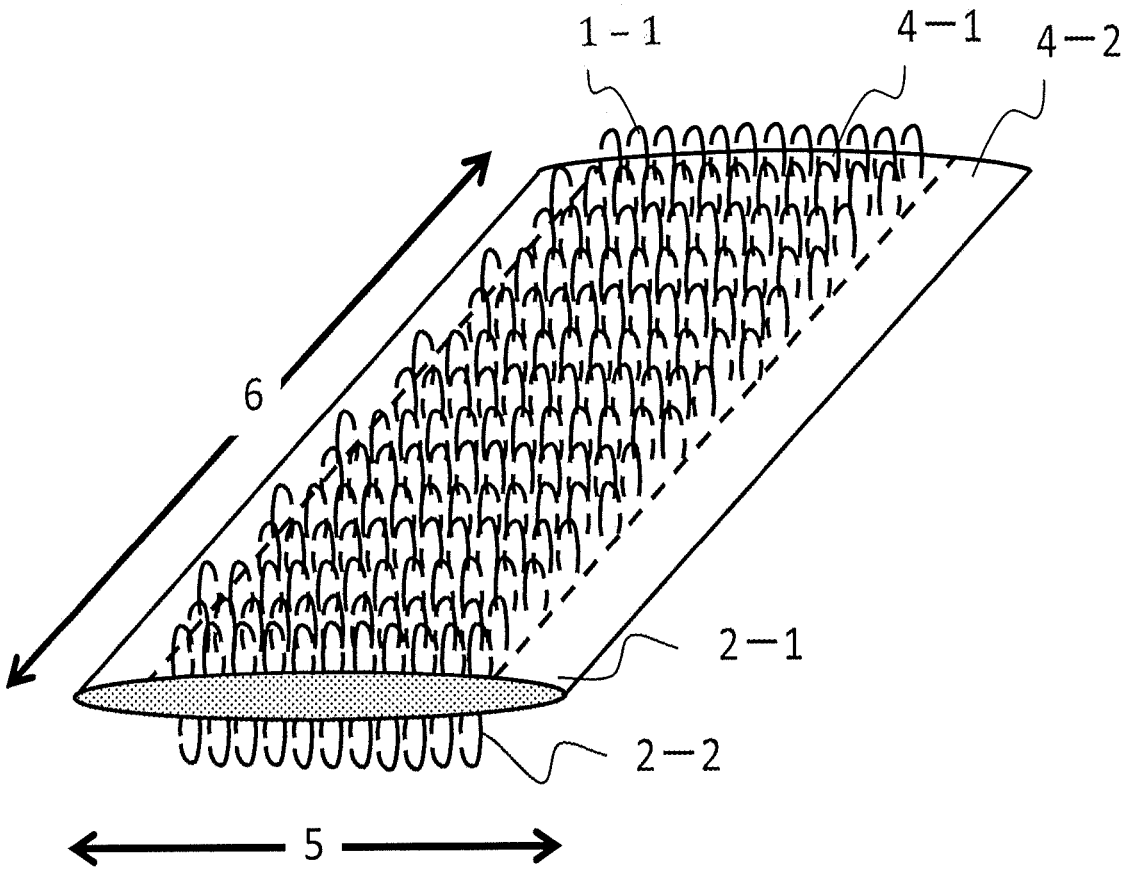
FIG. 13 is a perspective view schematically illustrating another example of the hook fastener having the hollow woven part according to the present invention.

1: loop fastener having a hollow woven part
1-1: hook fastener having a hollow woven part
2-1: front woven part of a hollow woven part
2-2: back woven part of a hollow woven part
3: single-layer woven part
4-1: engaging element
4-2: region with no engaging element
5: weft direction
6: warp direction
7-1: a single warp
7-2: a single warp
7-3: a single warp
7-4: a single warp
8: an engaging element yarn
9: region where a warp or an engaging element is under a weft
10: region where a warp is over a weft
11: region where an engaging element yarn is over a weft
12: region where an engaging element yarn foims a loop on a front surface
13: region where an engaging element yarn forms a loop on a back surface
14: weft As illustrated in FIGS. 1 to 6, a loop fastener (1) having a hollow woven part according to an embodiment is composed of a base cloth and engaging elements provided on the base cloth. FIGS. 12 and 13 show hook fasteners (1-1) according to the embodiments of FIGS. 1 and 2. The base cloth is provided with a hollow woven part and, in some cases, a single-layer woven part (3) adjacent the hollow woven part in the weft direction or the warp direction. The hollow woven part is composed of a front woven part (2-1) and a back woven part (2-2).

Figure 2:
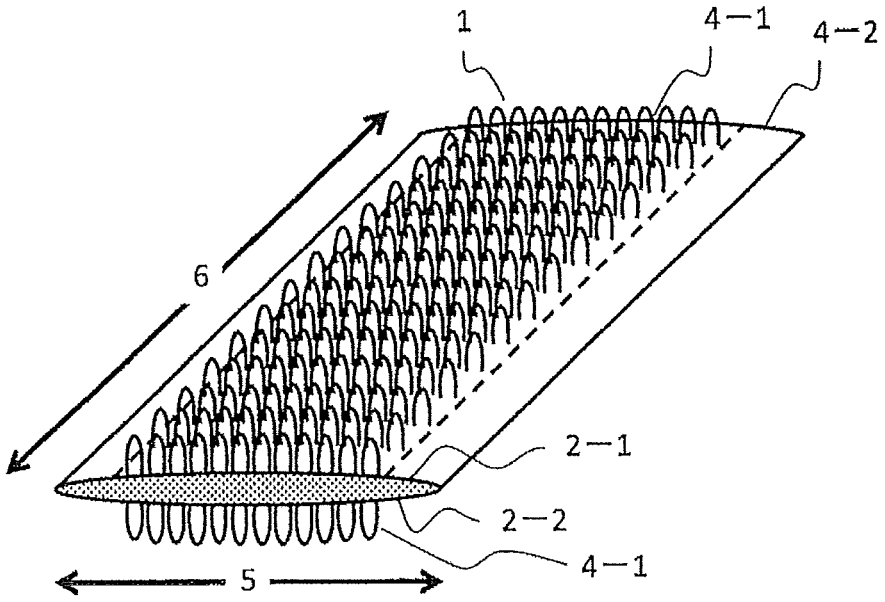
FIG. 2 is a perspective view schematically illustrating another example of the loop fastener having the hollow woven part according to the present invention.

As illustrated in FIGS. 1 to 6, the engaging elements are provided on the external surface of the front woven part or the back woven part of the hollow woven part. The engaging elements may be loop-shaped engaging elements or hook-shaped engaging elements, or alternatively, loop-shaped engaging elements and hook-shaped engaging elements may be provided on the same surface. As illustrated in FIG. 2, the engaging elements may be provided on both the front surface and the back surface of the hollow woven part. The loop-shaped engaging elements may be provided on one of the surfaces of the hollow woven part while the hook-shaped engaging elements are provided on the other surface of the hollow woven part. The hook-shaped engaging elements or the loop-shaped engaging elements may be provided on one of or both surfaces of the single-layer woven part.

Figure 3:
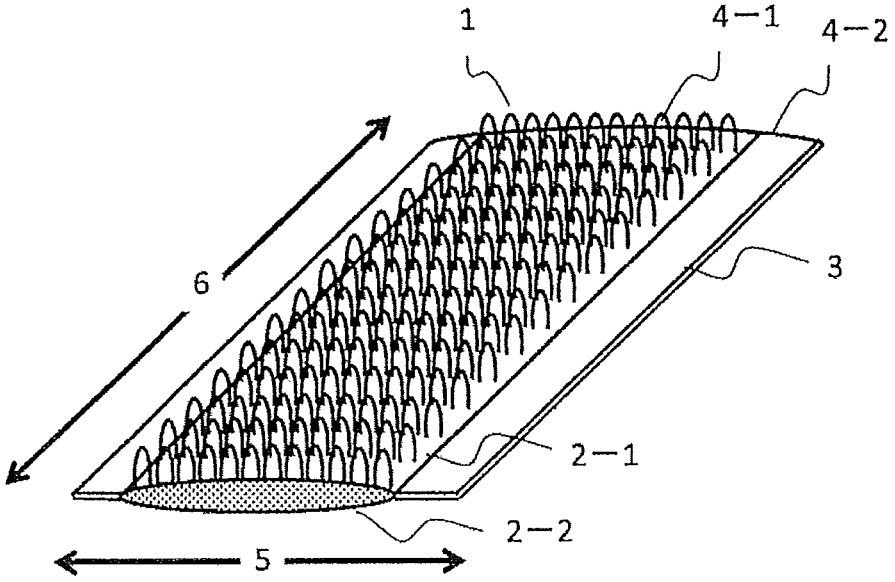
FIG. 3 is a perspective view schematically illustrating another example of the hook-and-loop fastener having the hollow woven part according to the present invention.
Figure 4:
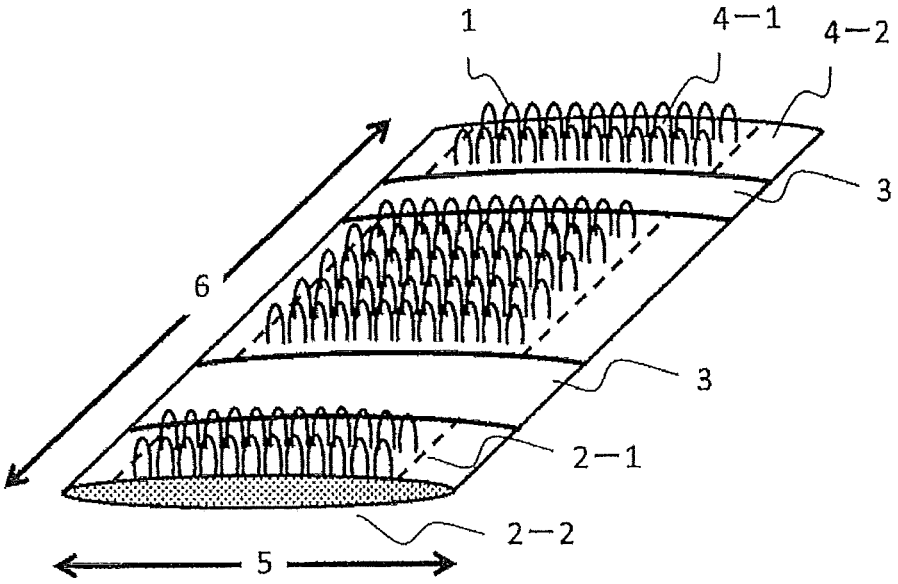
FIG. 4 is a perspective view schematically illustrating another example of the hook-and-loop fastener having the hollow woven part according to the present invention.
Figure 5:
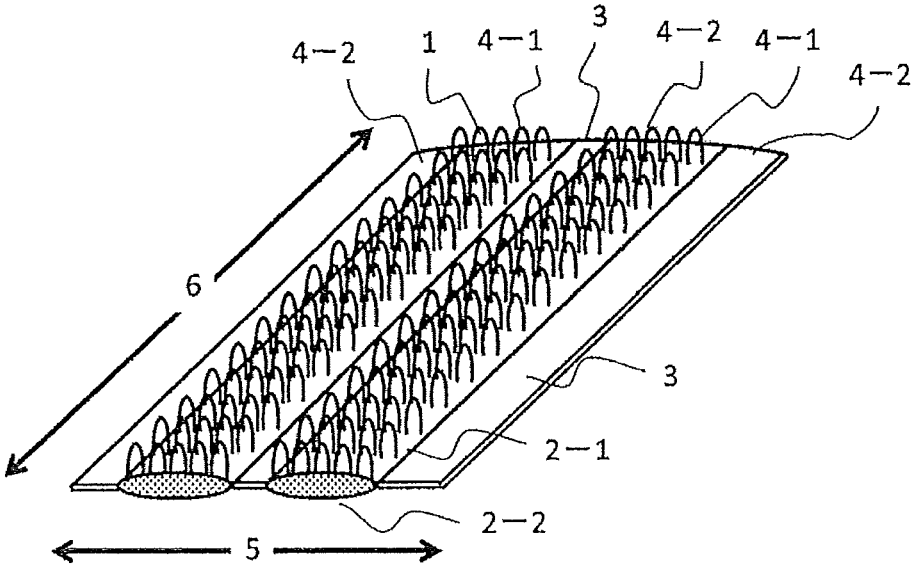
FIG. 5 is a perspective view schematically illustrating another example of the hook-and-loop fastener having the hollow woven part according to the present invention.
Figure 6:
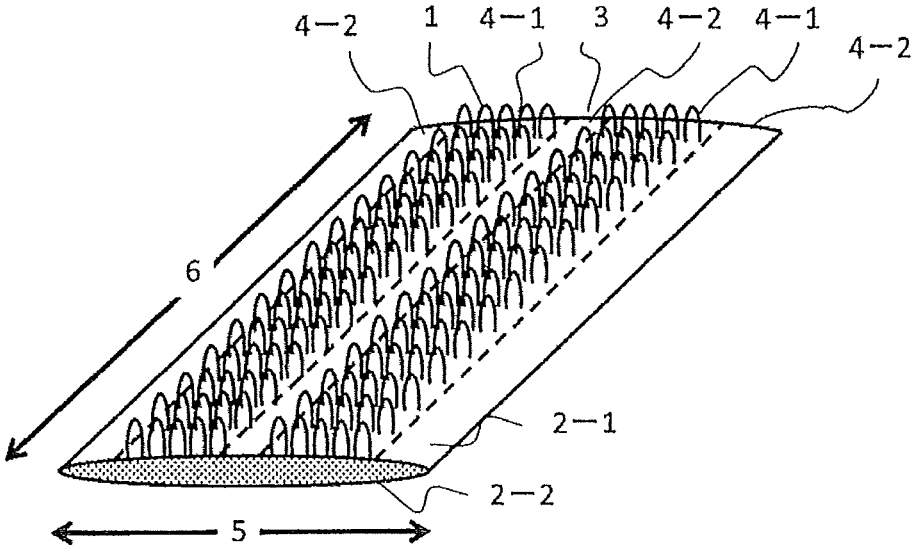
FIG. 6 is a perspective view schematically illustrating another example of the hook-and-loop fastener having the hollow woven part according to the present invention.

In FIGS. 1 to 6, reference sign 5 indicates the weft direction and reference sign 6 indicates the warp direction. As illustrated in FIG. 3, the single-layer woven part may be provided adjacent the hollow woven part in the weft direction. The hook-shaped engaging elements or the loop-shaped engaging elements may be provided on the front surface or the back surface of the single-layer woven part. As illustrated in FIG. 4, the single-layer woven part may be provided adjacent the woven part in the warp direction. Moreover, as illustrated in FIG. 5, a plurality of hollow woven parts may be provided along the weft direction with a single-layer woven part between every two hollow woven parts. As illustrated in FIG. 6, the hollow woven part may have a region (4-2) on the front surface where no engaging element is provided.

The ratio of the area of the hollow woven part to the area of the single-layer woven part according to the embodiment is preferably 55:45 to 98:2. Advantages of the area ratio being within this range are that the opening of the hollow portion can easily be expanded when a component is inserted in the hollow woven part and that the rupture strength, or the tear strength, and the engaging strength can both be obtained. By providing the single-layer woven parts on the rims of the hook-and-loop fastener within such an area ratio, another advantage can be obtained. That is, tearing at the rim and damage to the engaging elements provided near the rim are hardly caused, and moreover, the single-layer woven part can be sewed easily.

In particular, in a case where the single-layer woven parts are provided in parallel along the warp direction as illustrated in FIG. 3, the tear strength of the single-layer woven part becomes greater as the number of times a warp intersects a weft in the single-layered woven part (the number of intersections of warp and weft that constitute the single-layer woven part (the number of insertions up and down)) increases. Accordingly, the number of intersections is preferably four or more. The front layer and the back layer of the hollow woven part easily tear apart when pulled by hands if the number of intersections of warp and weft in the single-layer woven part is small, but hardly tear apart if the number of intersections of warp and weft in the single-layer woven part is large.

With reference to FIG. 1, the external surface of the front woven part according to the embodiment is the surface of the hollow woven part on which the engaging elements are provided. With reference to FIG. 2, the external surface of the back woven part is the back surface (2-2) of the hollow woven part on which the engaging elements are provided.

In the embodiment, the base cloth is basically composed of warps, wefts, and engaging element yarns. Among these main yarns, the present invention requires that the weft contains thermal bonding fibers. The thermal bonding fibers are thermally melted in the process of manufacturing the hook-and-loop fastener to fix the engaging elements to the base cloth. For the hook-and-loop fastener having a hollow woven part that does not allow usage of a conventional technique of fixing engaging element yarns to the base cloth by applying an adhesive liquid on the back surface, it can be understood that the technique of the present invention making use of thermal bonding fibers is a very useful technique to fix the engaging element yarns. This will be explained in detail in the description on the weft.

Fibers used for the warps, the wefts, and the engaging element yarns to form the hook-and-loop fastener according to the embodiment are preferably polyester-based fibers substantially composed of polyester-based polymers, which do not cause undulation by heat or by absorbing water or moisture (the state of the base cloth of the hook-and-loop fastener forming an irregular shape which deviates from a horizontal plane) and have a good thermal bonding property.

Conventionally, polyamide-based fibers, such as nylon-6 and nylon-66, have widely and generally been used for hook-and-loop fasteners having a woven base cloth. The base cloth consists of polyamide-based fibers, however, may change its shape by absorbing water or moisture or by heat, which sometimes results in deformation due to undulation of the base cloth caused by absorbing water or moisture or by heat treatment. This disadvantageously degrades quality and high-class appearance of a product including a hook-and-loop fastener. The hook-and-loop fastener disadvantageously has a poor thermal bonding property and what is worse is that a high engaging strength, which is the most important characteristic of the hook-and-loop fastener, cannot always be provided.

To solve such a problem, fibers mainly consist of polyester-based polymer are preferably used as fibers composing the warps, the wefts, and the engaging element yarns.

Polyester-based polymer is a polyester composed mainly of ethylene terephthalate units or a polyester composed mainly of butylene terephthalate units, which is usually produced by condensation reaction between terephthalic acid and ethylene glycol or between terephthalic acid and butanediol.

A small amount of polymetric units, except a polymetric unit of terephthalic acid and ethylene glycol and a polymetric unit of terephthalic acid and butanediol, may be added. Such polymetric units typically added are aromatic dicarboxylic acid such as isophthalic acid, sulphoisophthalic soda, phthalic acid, and naphthalene dicarboxylic acid, alphatic or alicyclic dicarboxylic acid such as adipic acid, sebacic acid, and cyclohexanedicarboxylic acid, diols such as propylene glycol, butanediol (for a polyester mainly composed of ethylene terephthalate units), ethylene glycol (for a polyester mainly composed of butylene terephthalate units), and cyclohexane dimethanol, and monocarboxylic acid such as hydroxybenzoic acid, oxycarboxylic acid such as lactic acid, acetic acid, and benzoic acid. A small amount of polymers other than those listed above may be added to the polyester.

Preferably, yarns other than the weft, namely, the warp and the engaging element yarn consist of polyethylene terephthalate homopolymer or polybutylene terephthalate homopolymer. The yarns are required to have a sufficiently high melting temperature so as not to melt at a heat treating temperature for melting the sheath part of a core-in-sheath thermal bonding fiber, which will be described later, preferably used as the fiber composing the weft. In particular, the main component of the yarns is preferably polyethylene terephthalate-based polyester or polybutylene terephthalate-based polyester. Other types of fibers may be blended, mixed, or aligned in the polyester fibers as required.

The warp is preferably a multifilament yarn. The multifilament yarn composing the warp is preferably composed of 20 to 40 filaments with the total decitex of 50 to 400. In particular, a multifilament yarn composed of 25 to 35 filaments with the total decitex of 120 to 200 is preferable.

It is preferable that the weft is also composed of a multifilament yarn. The multifilament yarn composing the weft is preferably a polyester-based yarn as described above. The multifilament yarn is preferably composed of 10 to 40 filaments with the total decitex of 50 to 150. In particular, the multifilament yarn preferably composed of 20 to 30 filaments with the total decitex of 80 to 120 is preferable.

The weft according to the embodiment contains thermal bonding fibers. An example of typical thermal bonding fibers is a core-in-sheath thermal bonding fiber including a thermal bonding component as a sheath part. The engaging element yarn can firmly be fixed to the base cloth by the thermal bonding fibers contained in the weft. This eliminates the need of applying a polyurethane-based or acrylic-based back-coat resin liquid (adhesive liquid) on the back surface of the base cloth of the hook-and-loop fastener, as in the case for a conventional hook-and-loop fastener, to prevent the engaging element yarns from being pulled off the base cloth.

As described above, the hook-and-loop fastener according to the embodiment has the hollow woven part formed of a double-layered fabric that consists of the front woven part and the back woven part. It is almost impossible to apply the adhesive liquid on the surface of the woven part which is at the opposite side of the surface on which the engaging elements are provided (on the internal surface of the hollow woven part). Though a conventional technique of applying the back-coat resin liquid cannot be used when thermal bonding yarn is used as the weft, firmly fixing the engaging element yarns to the base cloth without applying the back-coat resin liquid becomes possible by using the weft containing thermal bonding fibers. Consequently, a hook-and-loop fastener having a hollow woven part provided with engaging elements, which cannot be obtained by the conventional technique of applying a back-coat resin liquid, can be provided.

The thermal bonding fibers may be used in the warp instead of the weft to fix the engaging element yarns to the base cloth. The number of intersections of the warp and the engaging element yarn, however, is very small compared to the number of intersections of the weft and the engaging element yarn, since the engaging element yarn is inserted in the base cloth in a direction parallel to the warp. Therefore, use of the thermal bonding fibers only in the warp may result in insufficient fixing of the engaging element yarns to the base cloth. Moreover, with use of the thermal bonding fibers only in the warp, it is difficult to keep constant tension in the base cloth which runs in the warp direction during continuous production of the hook-and-loop fastener, making it difficult to stably and continuously produce the hook-and-loop fasteners with a certain quality.

Preferably, the core-in-sheath thermal bonding fiber consists of polyester-based resin to melt the sheath part to firmly fix the root of the engaging element yarn to the base cloth. For example, such a polyester-based fiber that has a core-in-sheath cross-section including a core part which does not melt under a heat treating condition and a sheath part which melts under the heat treating condition may be used.

An exemplary fiber is a core-in-sheath polyester fiber having a core part consists of polyethylene terephthalate and a sheath part consists of polyethylene terephthalate copolymer produced by copolymerization of a large amount, for example 15 to 30 mol %, of copolymer components such as isophthalic acid and adipic acid which greatly reduces the melting temperature or the softening temperature. The melting temperature or the softening temperature of the sheath part is 100 to 210° C. and preferably below the melting point of the fibers composing the warp, the core part, and the engaging element yarn by 20 to 150° C. The core-in-sheath thermal bonding fiber may have a cross-section of a concentric core and sheath, an eccentric core and sheath, a single core and sheath, or multiple cores and sheath. A core part may not fully be covered by a sheath part. A core part and a sheath part may simply be disposed side by side.

Regarding the percentage of the core-in-sheath thermal bonding fibers in the fibers composing the weft, it is preferable that the whole weft is substantially composed of the core-in-sheath thermal bonding fibers, that is, the weft is a multifilament yarn composed of core-in-sheath thermal bonding filaments, which firmly fixes the engaging elements to the base cloth.

If the fiber composing the weft does not have a core-in-sheath cross-section and the entire cross-section of the fiber consists of a thermal bonding polymer, which becomes brittle and easily cracks after melting and curing, the sewed base cloth easily tears from the sewed portion. Thus, the thermal bonding fiber preferably includes a resin that does not melt and has a core-in-sheath cross-section. The weight ratio of the core part to the sheath part is preferably within the range from 20:80 to 80:20, more preferably from 40:60 to 60:40.

The engaging element yarn composing a hook-shaped engaging element is required to resist against extension of a hook shape under a small force, that is, to retain the hook shape and have rigidity, and therefore a thick monofilament composed of synthetic fibers is used as the engaging element yarn. A preferably used yarn is a monofilament yarn that consists of polyethylene terephthalate-based polyester or polybutylene terephthalate-based polyester, which has excellent properties to retain a hook shape and does not melt at the temperature under which the thermal bonding fiber melts.

Such a monofilament yarn consists of polyethylene terephthalate-based polyester or polybutylene terephthalate-based polyester and composing the hook-shaped engaging element may preferably have a diameter of 0.14 to 0.25 mm to have a sufficient engaging strength, more preferably 0.16 to 0.22 mm. The cross-section of the monofilament may have different shapes, exemplified by a polygon such as a triangle and a rectangle, to have a higher engaging strength.

The loop-shaped engaging element is preferably composed of multifilament yarns that consist of, like the hook-shaped engaging element, polyethylene terephthalate-based polyester or polybutylene terephthalate-based polyester and do not melt under the temperature under which the thermal bonding fiber melts. In particular, the multifilament yarn consists of polyethylene terephthalate-based polyester is preferable because the loops easily separate from each other and stay upright. Preferably, the multifilament yarn composing the loop-shaped engaging element yarn is a multifilament yarn composed of 5 to 12 filaments with the total decitex of 150 to 400, more preferably, a multifilament composed of 6 to 9 filaments with the total decitex of 200 to 300.

The warp, the weft, and the engaging element yarn described above constitute the hook-and-loop fastener having the hollow woven part.

The present invention includes a method of manufacturing the hook-and-loop fastener having the hollow woven part composed of the warp, the weft, and the engaging element as described above.

The method of manufacturing a hook-and-loop fastener is a method of manufacturing a hook-and-loop fastener including a base cloth composed of warps, wefts, and engaging element yarns and engaging elements formed of the engaging element yarns provided on a surface of the base cloth. The method includes: a step of providing a hollow woven part formed of a double-layered fabric that consists of a front woven part and a back woven part; a step of forming the hollow woven part with a weft constituting the front woven part continuing to a weft constituting the back woven part, or alternatively, with the warp or the weft constituting a single-layer woven part, in a region where the hollow woven part is not formed, divided into yarns constituting the front woven part and yarns constituting the back woven part; a step of providing the engaging elements on an external surface of the front woven part of the hollow woven part; and a step of fixing the engaging element yarns to the base cloth by the thermal bonding fibers contained in the wefts. Each step can be performed using a conventional apparatus as will be described below.

The hook-and-loop fastener having the hollow woven part provided with the engaging elements as described in the embodiment, in some cases, a hook-and-loop fastener having a single-layer woven part provided adjacent a hollow woven part in the weft direction or the warp direction, can easily be manufactured using an apparatus that controls a warp heddle frame to reciprocate by electric signals, namely, an electronic dobby.

Reciprocation of the heddle frame is controlled with electric signals to weave a part having continuously and alternately formed hollow woven parts and single-layer woven parts. Alternatively, the weft inserted in the front woven part is turned to be directed again to an insertion point and then inserted in the back woven part, so that the weft constituting the front woven part continues to the weft constituting the back woven part. By inserting the weft in this manner at both ends in the warp direction, the hollow woven part is formed. A section of the weft turned and inserted again in the same layer may be secured by a braided yarn.

Typically, to weave a hook-and-loop fastener, engaging element yarns and warps are first set up and then a group of the engaging element yarns and warps are repetitively raised and lowered while another group of the engaging elements and warps moves in the opposite direction to insert a weft between the raised group and the lowered group. In the embodiment, the combination of cycles of raising and lowering the engaging element yarns and the warps is varied to weave the weft and the warps into a hollow woven part consisting of an upper layer and a lower layer or into a single woven layer.

The part woven into an upper layer and a lower layer includes a single weft constituting the upper layer and the lower layer, which means that a hollow woven part consists of a front woven part and a back woven part and continues at both ends in the weft direction of the woven part.

To continuously and alternately weave hollow woven parts and single-layer woven parts in the embodiment, a weft may need to be inserted 100 times or more per a weaving cycle. A typical cam dobby or a chain card dobby is only capable of inserting a weft as high as ten times per cycle by physical limitation. Accordingly, an electronic dobby is effective to insert a weft 100 times or more per a weaving cycle.

The engaging element yarns inserted in parallel to the warps are included only in the upper layer, only in the lower layer, or in both the upper layer and the lower layer. The engaging element yarns are inserted only in the upper layer to form a hook-and-loop fastener provided with engaging elements only on the front woven part. The engaging element yarns are inserted only in the lower layer to form a hook-and-loop fastener provided with engaging elements only on the back woven part. The engaging element yarns are divided to be included in the upper layer and in the lower layer to form a hook-and-loop fastener provided with engaging elements on the front woven part and the back woven part. The loop-shaped engaging element yarns are inserted only in the upper layer and the hook-shaped engaging element yarns are inserted only in the lower layer to form a hook-and-loop fastener provided with loop-shaped engaging elements on the front woven part and hook-shaped engaging elements on the back woven part.

The hollow woven part preferably has a total warp density of 40 to 90 yarns/cm in the front woven part and the back woven part. The ratio of the number of warps in the front woven part to the number of warps in the back woven part is preferably from 1:3 to 3:1. The weft density of the front woven part is preferably 14 to 24 yarns/cm and the weft density of the back woven part is preferably 14 to 24 yarns/cm. The total number of the wefts in the front woven part and the wefts in the back woven part is usually the same as the number of wefts in the single-layer woven part.

The engaging element yarns are weaved in parallel to the warps and rise up midway in the woven part from the base cloth. For a hook fastener, the engaging element yarn is weaved to form a loop, crossing over one to three warps, and to be inserted between the warps. For a loop fastener, the engaging element yarn is weaved to form a loop without crossing over any warp and stay approximately parallel to the warps. A hook-and-loop fastener having a weaving structure satisfying both the structure of the hook fastener and the structure of the loop fastener is preferable in that one of legs of each looped engaging element can efficiently be cut to form a hook-shaped engaging element, the engaging element yarns can firmly be fixed to the base cloth, and the hook-shaped engaging element easily engages with the loop-shaped engaging element.

The number of monofilament yarns for hook-shaped engaging elements and the number of multifilament yarns for loop-shaped engaging elements are each preferably about 3 to 7 per 20 warps. For a hook-and-loop fastener having hook-shaped engaging elements and loop-shaped engaging elements on the same surface, the total number of monofilament yarns for hook-shaped engaging elements and multifilament yarns for loop-shaped engaging elements is preferably 5 to 9 per 20 warps. The ratio of the number of monofilament yarns for hook-shaped engaging elements to the number of multifilament yarns for loop-shaped engaging elements is preferably within the range from 1:1 to 1:3.

A single-layer woven part can be formed as follows. The weft forming the front woven part and the weft forming the back woven part join again at an end in the weft direction of the hollow woven part and then a warp is inserted, or alternatively, the warp forming the front woven part and the warp forming the back woven part join again at an end in the warp direction of the hollow woven part, and then a weft is inserted, to form a single-layer woven part. The single-layer woven part and the hollow woven part are alternately formed repetitively along the weft direction or the warp direction by the required number of times (for example, according to the width of the hollow woven part). As described above, the hook-and-loop fastener according to the embodiment is formed such that the weft or the warp constituting the front woven part and the back woven part of the hollow woven part also constitute the single-layer woven part formed adjacent the hollow woven part, or alternatively, the weft continuously constitutes the front woven part and the back woven part of the hollow woven part, so that the hook-and-loop fastener according to the embodiment has no such problem of the hollow woven part easily coming off the hook-and-loop fastener, which happens in a conventional hook-and-loop fastener having a hollow woven part. To further effectively prevent the front woven part and the back woven part of the hollow woven part from coming off the hook-and-loop fastener, a thick weft or a strong weft may be used or the density of inserting the weft may be increased.

In particular, as illustrated in FIG. 4, a single-layer woven part is formed along the warp direction to create a bottom or a lid of a hollow woven part, which allows the hollow woven part to be covered on a bar-shaped object or to be used as a pocket container. For example, a hook-and-loop fastener containing an IC chip in the container may engage with a hook-and-loop fastener attached to a component or a clothing to perform product management or personnel management.

The woven part for a hook-and-loop fastener as described above is then heated to melt the thermal bonding fibers in the weft. At this time, the heating is performed preferably at the temperature of 160 to 210° C. to only melt the thermal bonding fibers. For the front woven part and the back woven part of the hollow woven part, the melted fiber adheres to the warp but almost only at points in contact with the woven warp, so that the front woven part and the back woven part of the hollow woven part do not adhere to each other to form a single layer in the step of melting the weft.

To provide a hook-shaped engaging element, one of legs of a looped engaging element is cut to form a hook-shaped engaging element. A typical trim cutter is used to cut the leg.

The hook-and-loop fastener according to the embodiment preferably has a portion provided with engaging elements with the density of 15 to 30 yarns/cm$^2$. The height of the engaging element is preferably within the range from 1.3 to 3.0 mm.

The embodiment is required that the engaging elements are provided on the front woven part of the hollow woven part to thereby stably and firmly be attached to an object. The range of new applications can be broadened by providing engaging elements on a single-layer woven part or a back woven part, or varying the type of the engaging elements, for example, providing hook-shaped engaging elements, loop-shaped engaging elements, or both hook-shaped engaging elements and loop-shaped engaging elements.

A bar-shaped object or a string-shaped object can be inserted in a hollow woven part provided on the hook-and-loop fastener according to the embodiment to firmly fix with ease the hook-and-loop fastener around the bar-shaped object or the string-shaped object. This bar-shaped object or string-shaped object can be attached to a sheet, a board, or a textile to which another hook-and-loop fastener is fixed. In such a manner, the object may be used, for example, as a signboard, a partition, or an extension member for setting up a tent. The hook-and-loop fastener can be used as a cable fixing attachment by inserting a cable in the hollow woven part and attaching another hook-and-loop fastener to a wall or the like.

As described above, product management or personnel management can be performed by inserting and securing an electronic part such as an IC chip in the hollow woven part. The hook-and-loop fastener having the hollow woven part according to the embodiment can be used as brushes by inserting a handle grip in the hollow woven part. The hook-and-loop fastener having a hollow woven part according to the embodiment may be attached to a frame of an umbrella and another hook-and-loop fastener may be attached to a cloth of the umbrella, which provides an umbrella that allows changing colors and hand grips as desired.

Further, the hook-and-loop fastener having a hollow woven part may also be used for fixing a covering sheet to cover stages in a construction site. The hook-and-loop fastener may be attached to a container or a human body by inserting a heat-keeper or a coolant in the hollow woven part.

Among various aspects of the technique disclosed herein, a main technique will be described below.

An aspect of the present invention relates to a hook-and-loop fastener including a base cloth composed of warps, a weft, and engaging element yarns and engaging elements formed of the engaging element yarns and provided on a surface of the base cloth. The hook-and-loop fastener includes a hollow woven part satisfying the following requirements that:

1) the base cloth has the hollow woven part formed of a double-layered fabric that consists of a front woven part and a back woven part;

2) a weft constituting the front woven part continues to a weft constituting the back woven part to form the hollow woven part, or alternatively, the weft or warps constituting a single-layer woven part, in a region where the hollow woven part is not formed, are divided into yarns constituting the front woven part and yarns constituting the back woven part to form the hollow woven part;

3) the engaging elements are provided on an external surface of the front woven part of the hollow woven part; and 4) the weft contains thermal bonding fibers and the engaging element yarns are fixed to the base cloth by the thermal bonding fibers.

With such a structure, a hollow woven part having any arbitrary width, not limited to a narrow hollow woven part, can be manufactured. Moreover, a hook-and-loop fastener provided with engaging elements also on a surface of the hollow woven part can be provided. Furthermore, a hook-and-loop fastener having a hollow woven part that does not come off the back surface of the hook-and-loop fastener can be provided.

The warp, the weft, and the engaging element yarn of the hook-and-loop fastener as described above preferably consist of polyester-based fibers. This is because polyester-based fibers do not undulate by absorbing heat, water, or moisture (the state of the base cloth of the hook-and-loop fastener having an irregular shape which deviates from a horizontal plane) and have a good thermal bonding property.

The hook-and-loop fastener as described above preferably has a single-layer woven part adjacent a hollow woven part in the warp direction or the weft direction with the area ratio of the hollow woven part to the single-layer woven part is 55:45 to 98:2. This configuration is advantageous in that the opening of the hollow can easily be expanded when inserting a component into a hollow woven part and that both the rupture strength or the tear strength and the engaging strength can be obtained. Providing a single-layer woven part within the abovementioned range on the rims of the hook-and-loop fastener also gives such advantages that the hook-and-loop fastener hardly tears from the rim, the engaging elements provided near the rim are hardly damaged, and sewing is easy at the single-layer woven part.

Moreover, the hook-and-loop fastener as described above preferably has engaging elements provided on the external surface of the back woven part or one or both surfaces of the single-layer woven part. This advantageously increases the area of the portion where engaging elements are provided and keeps the hook-and-loop fastener to function as a fastener even with a component inserted in the hollow woven part.

Desirably, the engaging elements provided on the hollow woven part of the hook-and-loop fastener as described above are loop-shaped engaging elements, hook-shaped engaging elements, or both loop-shaped engaging elements and hook-shaped engaging elements. This advantageously eliminates the need of selecting a hook-and-loop fastener with which the hook-and-loop fastener having the hollow woven part engages.

EXAMPLES

The present invention will be described based on examples. Hook strength in the examples was measured based on JIS L 3416. To measure the hook strength of a loop-shaped engaging element, a hook fastener manufactured by Kuraray Fastening Co., Ltd. was used to engage with the loop-shaped engaging elements. To measure the hook strength of a hook fastener, a loop fastener manufactured by Kuraray Fastening Co., Ltd. was used to engage with the hook fastener.

First Example

A warp, a weft, and a multifilament yarn for a loop-shaped engaging element that constitute a base cloth of a hook-and-loop fastener were prepared as follows.

[Warp]

Multifilament yarn consists of polyethylene terephthalate having a melting temperature of 260° C.

Total decitex and the number of filaments: 167 dtex, 30 filaments

[Weft (Multifilament Thermal Bonding Yarn Composed of Core-in-Sheath Combined Fibers)]

Core part: polyethylene terephthalate (melting temperature: 260° C.)

Sheath part: polyethylene terephthalate copolymer including polymerized isophtalic acid by 25 mol % (softening temperature: 190° C.)

Core to sheath ratio (by weight): 70:30

Total decitex and the number of filaments: 116 dtex, 24 filaments

[Multifilament Yarn for Loop-Shaped Engaging Element]

Polybutylene terephthalate fiber (melting temperature: 220° C.)

Total decitex and the number of filaments: 265 dtex, 7 filaments

Figure 7:
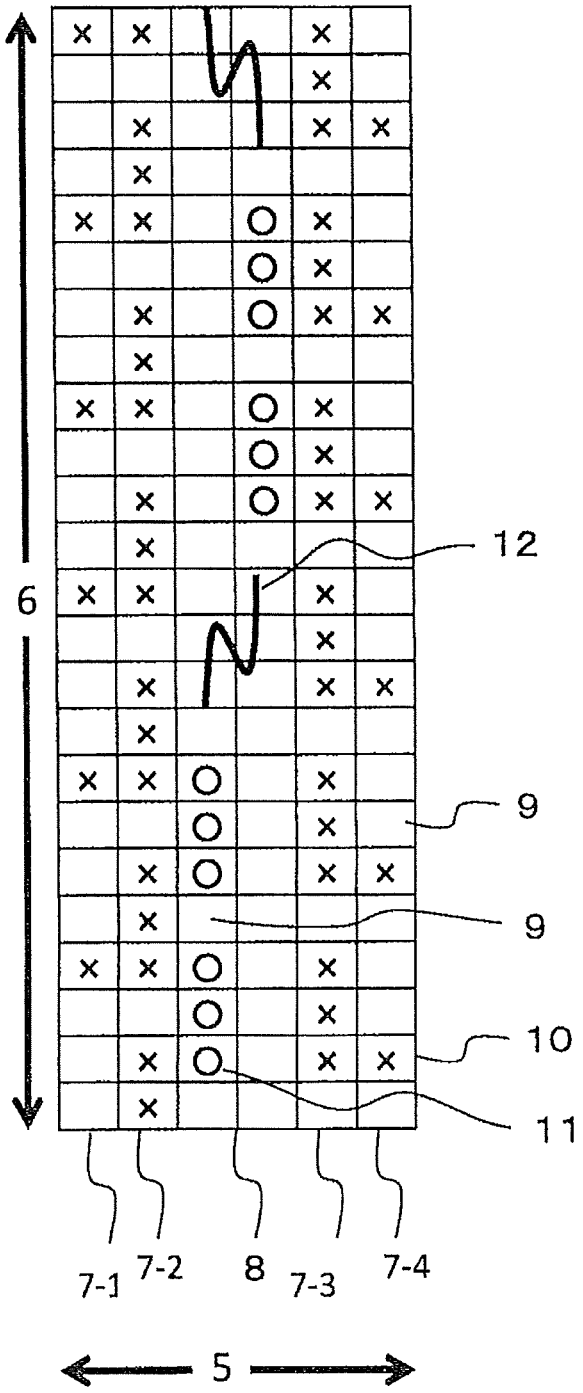
FIG. 7 illustrates a weaving structure of a hollow woven part used in a first example.

From the three types of yarns, using an electronic dobby as a weaving device, a hook-and-loop fastener having a hollow woven part with a weaving structure illustrated in FIG. 7 was manufactured. The weft density was 32 yarns/cm in both the front woven part and the back woven part of the hollow woven part. The warp density was 65 yarns/cm in both the front woven part and the back woven part of the hollow woven part.

In weaving of the hollow woven part, the front woven part and the back woven part were weaved separately by inserting a weft in the back woven part after one insertion of the same weft in the front woven part. However, the front woven part and the back woven part were connected at right and left rims of the hook-and-loop fastener by the continuous weft, and therefore the hook-and-loop fastener was formed in a sleeve shape. Since the weft was alternately inserted in a plain weave of the front woven part and a plain weave of the back woven part, the number of insertions in the front woven part and the back woven part, in weaving condition, was set double the number of insertions for a typical plain weave.

One loop-shaped engaging element yarn was provided for every four warps in the direction parallel to the warp in a portion which was weaved into the hollow woven part, thereby providing loop-shaped engaging elements only on the front woven part.

The loop-shaped engaging elements were provided on the front woven part of the hollow woven part with an element density of 40 elements/cm$^2$, and the height of the loop-shaped engaging elements from the surface of the base cloth (namely, the surface of the front woven part) was 2.5 mm. After finishing the weaving of the woven part for the hook-and-loop fastener, the loop-shaped engaging elements were fixed to the woven part by heating at 200° C. under which only the sheath part in the weft melts. The shear hook strength of the obtained hook-and-loop fastener was 8 N/cm$^2$ and the peel-off hook strength was 1 N/cm, which are excellent for the hook-and-loop fastener.

Figure 14:
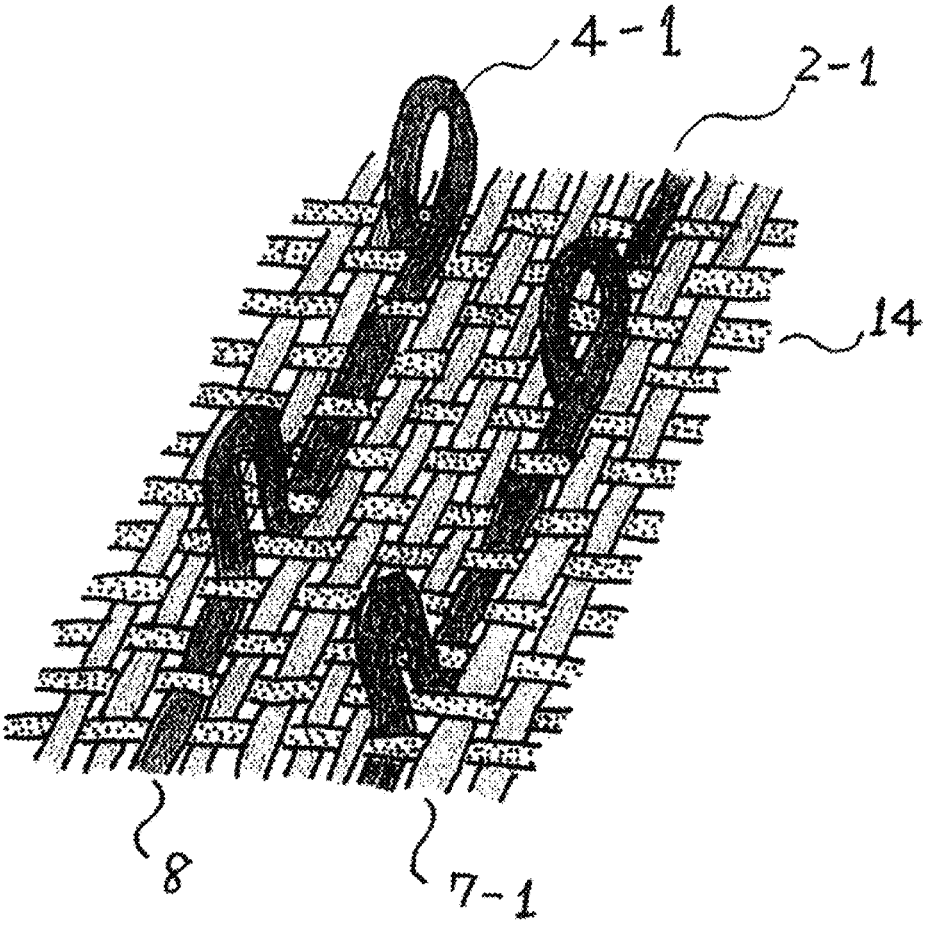
FIG. 14 is a schematic view illustrating a layer of front woven part of hook-and-loop fastener having the hollow woven part according to the present invention.
Figure 15:
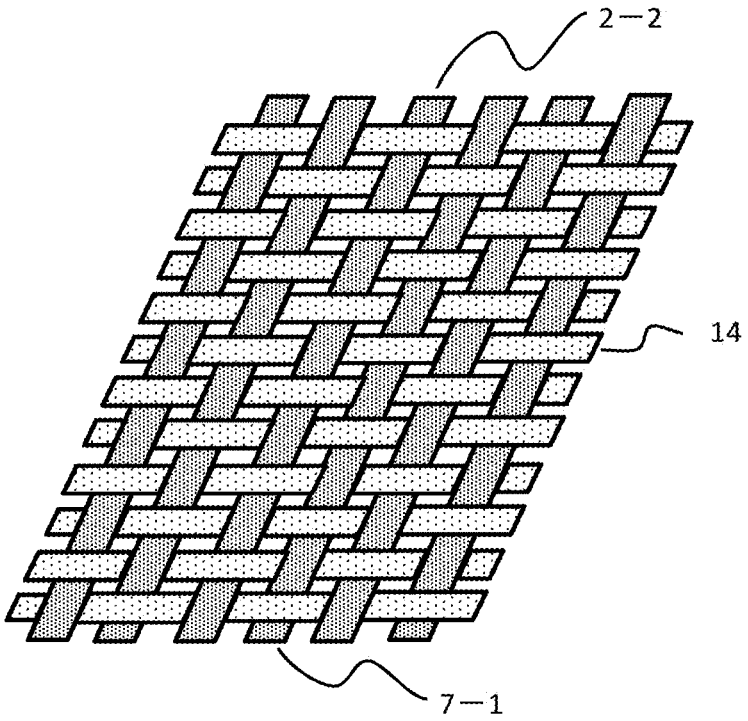
FIG. 15 is a schematic view illustrating a layer of back woven part of hook-and-loop fastener having the hollow woven part according to the present invention.

FIG. 14 shows a layer of front woven part of hook-and-loop fastener having the hollow woven part according to the present invention, in which warp yarn, weft yarn (thermal bonding fiber) and loop yarn are present. FIG. 15 shows a layer of back woven part of hook-and-loop fastener having the hollow woven part according to the present invention, in which warp yarn and weft yarn (thermal bonding fiber) are present (i.e. no loop yarn exists).

In this example, such an apparatus that sequentially performs weaving, heat treatment, and final wind up was used.

The obtained hook-and-loop fastener was provided with loop-shaped engaging elements provided on the front woven part of the hollow woven part and the weft of the front woven part continuing to the weft of the back woven part of the hollow woven part. Thus, the back woven part of the hollow woven part never came off the hook-and-loop fastener. The front woven part and the back woven part of the hollow woven part both kept textile flexibility to fit on any shape of the surface of the hook fastener.

A cable was inserted in the hollow woven part of the hook-and-loop fastener, and the hook-and-loop fastener was engaged, by loop-shaped engaging elements, with a hook fastener attached to a wall to secure the cable on the wall. The attached cable was easily removed by peeling off the hook-and-loop fastener from the hook fastener when necessary.

An IC chip was inserted in the hollow woven part of the obtained hook-and-loop fastener. The both openings of the hollow were closed by thermal bonding, and thereby an IC chip embedded hook-and-loop fastener was made. The IC chip embedded hook-and-loop fastener was fixed onto a cardboard box by engaging with a hook fastener attached to the external of a cardboard box. Management of the cardboard box was facilitated by managing the information stored in the IC chip.

Second Example

Figure 8:
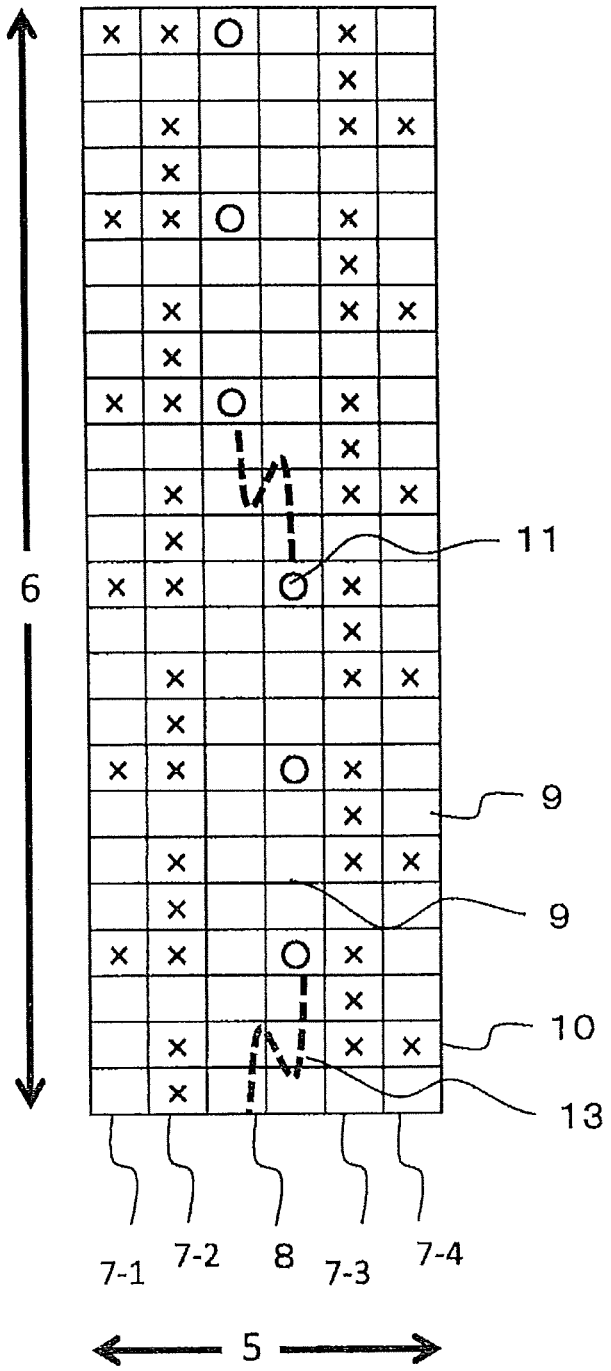
FIG. 8 illustrates a weaving structure of a hollow woven part used in a second example.

A hook-and-loop fastener having a hollow woven part provided with loop-shaped engaging elements on the surfaces of both the front woven part and the back woven part of the hollow woven part was manufactured. In this manufacturing, the back woven part was woven according to the weaving structure illustrated in FIG. 8 so as the loop-shaped engaging elements to be provided also on the back woven part, and the other portion was woven in the same manner as in the first example.

The obtained hook-and-loop fastener having a hollow woven part was provided such that a continuous weft serves as the weft of the front woven part and the weft of the back woven part of the hollow woven part. Thus, the back woven part of the hollow woven part never came off the hook-and-loop fastener. Moreover, the hollow woven part provided on the hook-and-loop fastener did not deteriorate flexibility of the hook-and-loop fastener.

The hook-and-loop fastener having a hollow woven part was cut along the weft direction to obtain a hook-and-loop fastener having a sleeve-like hollow. A handle grip was inserted in the sleeve-like hollow to form a lint brush for clothing. Lint and dust were easily cleaned off from a clothing by using the lint brush.

Third Example

A hook-and-loop fastener having a hollow woven part provided with hook-shaped engaging elements on the front woven part of the hollow woven part was manufactured. In this manufacturing, the loop-shaped engaging element yarns of the first example were replaced with hook-shaped engaging element yarns, the hook-shaped engaging elements were weaved to cross over two warps, which are warps indicated by reference signs 7-2 and 7-3 in FIG. 7, and one leg of the loop forming a hook-shaped engaging element was cut after heat treatment. Other parts were the same as in the first example.

Hook-shaped engaging element yarn: polyethylene terephthalate fiber (melting temperature: 260° C.)

Fineness: 390 decitex (diameter: 0.19 mm)

The obtained hook-and-loop fastener having a hollow woven part includes a continuous weft that serves as the weft of the front woven part and the weft of the back woven part of the hollow woven part. Thus, the back woven part of the hollow woven part never came off the hook-and-loop fastener. Moreover, the hollow woven part provided on the hook-and-loop fastener did not deteriorate flexibility of the hook-and-loop fastener.

The obtained hook-and-loop fastener showed a very good performance with the shear hook strength of 8 N/cm$^2$ and the peel-off hook strength of 1 N/cm. The obtained hook-and-loop fastener having a hollow woven part was cut along the weft direction to obtain a hook-and-loop fastener having a sleeve-like hollow.

A metal pole was inserted in the sleeve-like hollow, and a plurality of the metal poles were vertically set upright on a floor. The loop fasteners were attached to the ends of a belt, and the belt was hung across the poles by engaging the loop fasteners with the hook-and-loop fasteners on the metal pole to be used as a partition belt. The hook-and-loop fasteners did not disengage even under a load on the belt. The belt worked as a very useful partition allowing the distance between the poles to be freely changed.

Fourth Example

Figure 9:
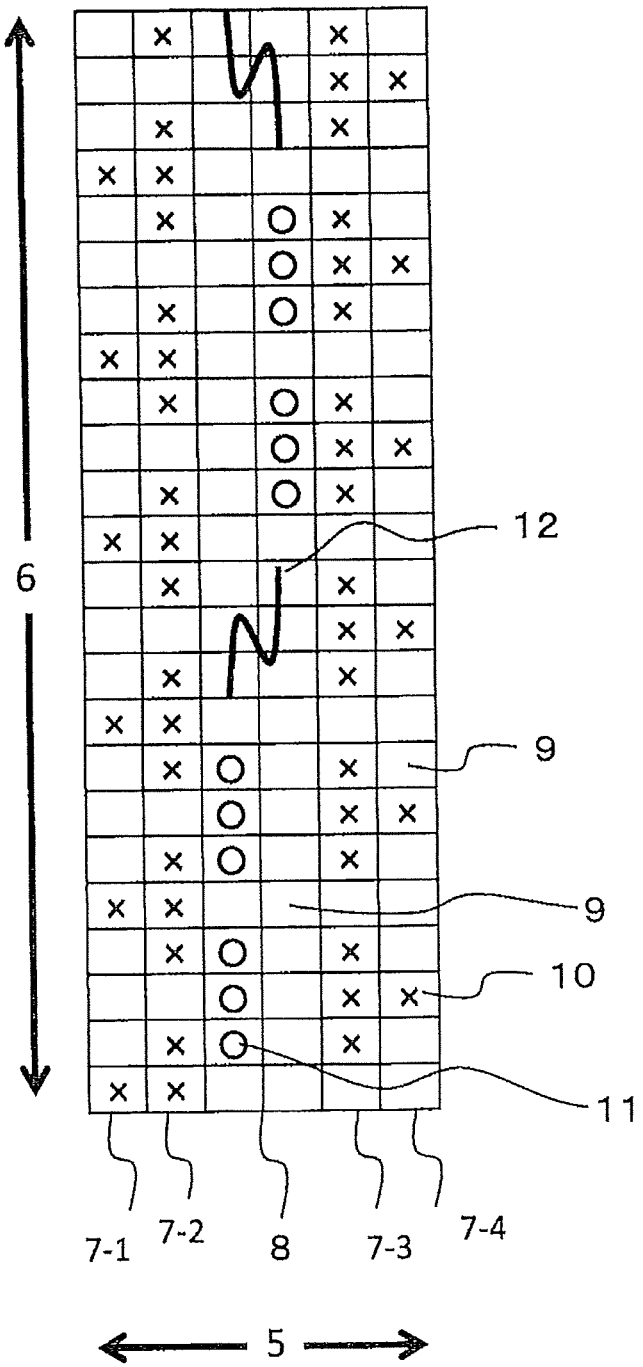
FIG. 9 illustrates a weaving structure of a single-layer woven part used in a fourth example.

In the first example, the single-layer woven part having a weaving structure illustrated in FIG. 9 provided in the warp direction was formed in the warp direction. Specifically, hollow woven parts according to the first example each having a length of 5 cm along the warp direction and single-layer woven parts each having a length of 6 mm along the warp direction were alternately formed along the warp direction. Along the weft direction, a hollow woven part according to the first example having a width of 5 cm and a single-layer woven part having a weaving structure illustrated in FIG. 9 and the width of 6 mm were formed side by side. Loop-shaped engaging element yarns were removed from the single-layer woven parts which serve as rims. The weaving structure illustrated in FIG. 7 is different from the weaving structure illustrated in FIG. 9 in that some locations of intersections where the warp is over or under the weft are shifted by one insertion of a weft.

Figure 10:
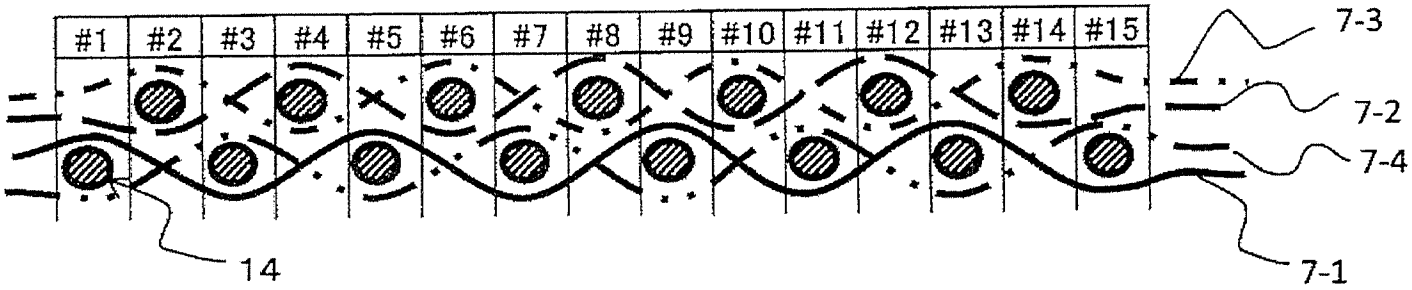
FIG. 10 is a schematic view illustrating a profile of weaved warps viewed from a cross-sectional direction of the weft of the hollow woven part used in the first example.

For a warp 7-1 in FIG. 7, the weft was consecutively inserted three times to set the warp under the weft, as indicated by reference sign 9, and then the weft was inserted once to set the warp over the weft, as indicated by reference sign 10. For a warp 7-2 adjacent the warp 7-1 to the right side, the weft was consecutively inserted three times to set the warp over the weft, as indicated by reference sign 10, and then the weft was inserted once to set the warp under the weft, as indicated by reference sign 9. As illustrated in FIG. 7, for example, the first of the three consecutive insertions of the weft indicated by reference sign 9 overlaps the insertion of the weft in the adjacent warp indicated by reference sign 9, which means that one warp was in the upper side while three warps were set in the lower side as viewed in both the warp direction and the weft direction. As illustrated in FIG. 10, the ratio of the number of warps over the weft to the number of warps under the weft repetitively alternates between 1:3 and 3:1, and the warp 7-1 and the warp 7-4 were weaved into a plain weave to form a lower layer, which is the back woven part, and the warp 7-2 and the warp 7-3 were weaved into a plain weave to form an upper layer, which is the front woven part. A plain-woven part consisting of an upper layer and a lower layer was thus formed. The woven part includes the continuous weft making turns at both ends in the width direction and therefore has a sleeve-like hollow structure.

Figure 11:
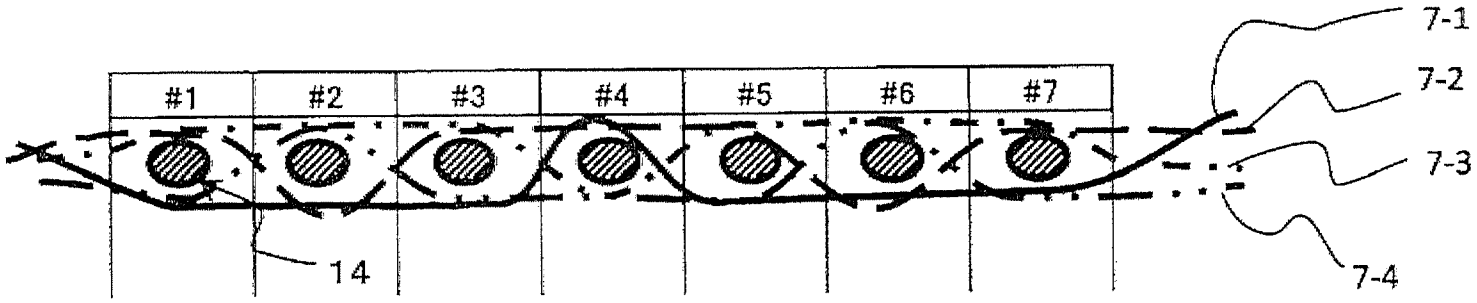
FIG. 11 is a schematic view illustrating a profile of weaved warps viewed from a cross-sectional direction of the weft of the single-layer woven part used in the fourth example.

As illustrated in FIG. 9, when an insertion indicated by reference sign 9 or reference sign 10 overlaps the second of the three consecutive insertions of the weft in the adjacent warp, two warps were set in the upper side while other two warps were set in the lower side as illustrated in FIG. 11. With two warps in the upper side and two warps in the lower side, two plain weaves were formed not separately and therefore a thick single-layer woven part was formed instead of a hollow woven part. Regarding the profile of a single warp, the warp 7-1 or the warp 7-4, for example, a weft was inserted over the warp consecutively three times and then inserted once under the warp. This structure resembles the structure of the hollow woven part, so that the weft-insertion density can be as high as the weft-insertion density in the hollow weave.

In a fourth example, a hook-and-loop fastener formed by combining the hollow woven parts and the single-layer woven parts was manufactured. In the manufacturing, a section having the structure illustrated in FIG. 7 was weaved for 5 cm and a section having the structure illustrated in FIG. 9 was weaved for 6 mm in the warp direction to form a single-layer woven part with 6 mm length for every hollow woven part with 5 cm length in the warp direction. In the weft direction, a section having the structure illustrated in FIG. 7 was weaved for 5 cm width and a section having the structure illustrated in FIG. 9 was weaved for 6 mm width to form a hollow woven part with 5 cm width and a single-layer woven part with 6 mm width side by side along the weft direction. Loop-shaped engaging element yarns were removed from the single-layer woven part which serves as a rim.

The hook-and-loop fastener having a hollow woven part was provided such that the hollow woven part did not deteriorate flexibility of the hook-and-loop fastener and the back woven part of the hollow woven part never came off the hook-and-loop fastener because the weft constituting the front woven part and the back woven part of the hollow woven part also constitutes the single-layer woven part adjacent the hollow woven part. With the hollow woven part and the single-layer woven part having almost the same weft-insertion density, the difference in the weft density between the hollow woven part and the single-layer woven part provided side by side along the width direction caused almost no external deformation such as undulation of the rim.

The hook-and-loop fastener was cut at the middle, in the warp direction, of the hollow woven part and then at the middle, in the warp direction, of the single-layer woven part to obtain a hook-and-loop fastener having a pocket with an opening. The hook-and-loop fastener having a pocket with an opening was attached to a hook fastener secured on a wall to be used as a container on the wall.

This application is based on Japanese Patent Application No. 2015-49045 filed on Mar. 12, 2015, the content of which is hereby incorporated by reference.

The present invention is properly and sufficiently described above using the embodiment with reference to the drawings. It should be understood that a person skilled in the art may easily alter and/or modify the embodiment described above. Therefore, alterations or modifications made by a person skilled in the art may fall within the scope of the claims unless the degree of such alterations or modifications is beyond the scope of the claims.

INDUSTRIAL APPLICABILITY

The present invention has a broad industrial applicability in the technical field of hook-and-loop fasteners.

The invention claimed is:

1. A hook-and-loop fastener, comprising a base cloth comprising warps, a weft, and engaging element yarns and engaging elements formed of the engaging element yarns and provided on a surface of the base cloth, wherein the hook-and-loop fastener comprises a hollow woven part satisfying the following requirements:

1) the base cloth has the hollow woven part formed of a double-layered fabric that consists of a front woven part and a back woven part;

2) the weft constituting the front woven part continues to the weft constituting the back woven part to form the hollow woven part, or alternatively, the weft or the warps constituting a single-layer woven part, in a region where the hollow woven part is not formed, are divided into yarns constituting the front woven part and yarns constituting the back woven part to form the hollow woven part;

3) the engaging elements are provided on an external surface of the front woven part of the hollow woven part; and 4) the weft comprises thermal bonding fibers and the engaging element yarns are fixed to the base cloth by the thermal bonding fibers.

2. The hook-and-loop fastener according to claim 1, wherein the warps, the weft, and the engaging element yarns consist of polyester-containing fibers.

3. The hook-and-loop fastener according to claim 1, wherein the single-layer woven part is provided adjacent the hollow woven part in a warp direction or a weft direction, and a ratio of an area of the hollow woven part to an area of the single-layer woven part is within a range from 55:45 to 98:2.

4. The hook-and-loop fastener according to claim 1, wherein engaging elements are provided on an external surface of the back woven part, or one or both surfaces of the single-layer woven part.

5. The hook-and-loop fastener according to claim 1, wherein the engaging elements provided on the hollow woven part are loop-shaped engaging elements, hook-shaped engaging elements, or a combination of the loop-shaped engaging elements and the hook-shaped engaging elements.

* * * * *